US006839911B1

(12) United States Patent
Mathews

(10) Patent No.: US 6,839,911 B1
(45) Date of Patent: Jan. 11, 2005

(54) GARMENT WITH SELECTABLE MITTENS

(76) Inventor: Arlene L. Mathews, 12822 W. 108th St., Overland Park, KS (US) 66210

( * ) Notice: Subject to any disclaimer, the term of this patent is extended or adjusted under 35 U.S.C. 154(b) by 0 days.

(21) Appl. No.: 10/712,569

(22) Filed: Nov. 13, 2003

(51) Int. Cl.[7] ..... A41D 13/00
(52) U.S. Cl. ..... 2/93; 2/69
(58) Field of Search ..... 2/93, 80, 83, 69, 2/85, 94, 115, 95, 125, 108, 243.1, 158, 159

(56) References Cited

U.S. PATENT DOCUMENTS 4,359,784 A * 11/1982 Harrington ..... 2/269
4,756,027 A * 7/1988 Buenos et al. ..... 2/123
5,117,507 A * 6/1992 Long ..... 2/158
5,125,117 A 6/1992 Buenos et al.
5,138,717 A 8/1992 Tolton
5,561,860 A * 10/1996 Nguyen-Senderowicz ..... 2/90
5,784,720 A * 7/1998 Mellon et al. ..... 2/125
5,815,837 A * 10/1998 Christman et al. ..... 2/158
5,913,408 A * 6/1999 Shanahan ..... 2/90
5,933,864 A * 8/1999 Boykins ..... 2/69
6,035,441 A * 3/2000 Mellon et al. ..... 2/125
6,076,189 A * 6/2000 Christman et al. ..... 2/158
6,249,916 B1 * 6/2001 Mellon et al. ..... 2/125
6,253,381 B1 * 7/2001 Kelley ..... 2/125

* cited by examiner

*Primary Examiner*—Gloria M. Hale
(74) *Attorney, Agent, or Firm*—Chase Law Firm, L.C.

(57) ABSTRACT

A garment construction having a cuff assembly at the end of the sleeve wherein the cuff assembly is user selectable between a first position allowing the user's fingers to extend beyond the opening of the sleeve and a second position wherein the user's fingers are covered by the cuff assembly. A thumb cover is selectable between a first position extending from the sleeve and a second position either depressed below the sleeve surface or held in place at a position extending along the sleeve. Purchase material on the cuff assembly and/or thumb cover presents a purchase surface which enhances the user's ability to pick up objects when the user's fingers and/or thumb are covered by the cuff.

18 Claims, 2 Drawing Sheets

GARMENT WITH SELECTABLE MITTENS

This invention is directed to garments and, more particularly, to an outer garment having an integral mitten construction on each sleeve selectable between functional and non-functional hand cover positions.

BACKGROUND OF THE INVENTION

Various garments have been proposed so as to provide a mitten for the hands of the wearer during cold weather or the like. Such devices include garments having gloves attached at the sleeve ends which can either cover or uncover the hands at the selection of the wearer. However, such garments have not disclosed mittens which are safely integrated into the garment when not in use. Moreover, when in use past garments have covered the hands which inhibited the easy grasping of articles by the wearer.

In response thereto I have provided an outer garment having a cuff construction at the sleeve ends presenting a cuff panel which is foldable between a first open position and a second closed position covering the wearer's fingers. Accompanying the cuff construction is a separate thumb cover which can either be depressed or extended relative to the sleeve proper when not in use so as to cosmetically hide the thumb cover. Purchase surfaces are presented along the exterior mitten surfaces which enable the covered hand to easily grasp articles or the like.

Accordingly, it is a general object of this invention to provide a garment having a cuff construction for selectably presenting mittens to the wearer.

Another particular object of this invention is to provide a garment, as aforesaid, having a first mode in which the hands normally extend beyond the end of the sleeve and a second mode for covering the hands.

Still another object of this invention is to provide a garment, as aforesaid, having a separate thumb cover which can be selectably extended away from the sleeve for insertion of the thumb therein.

Another object of the invention is to provide a garment, as aforesaid, wherein the thumb cover may be selectably embedded beneath the sleeve or extends along the sleeve so as to enhance the cosmetic appearance of the garment.

A further object of this invention is to provide a garment, as aforesaid, having purchase surfaces selectably presented at the ends thereof which allow the covered hands of the wearer to grasp objects, Other objects and advantages of this invention will become apparent from the following description taken in connection with the accompanying drawings, wherein is set forth by way of illustration and example, a now preferred embodiment of this invention.

BRIEF DESCRIPTION OF THE SEVERAL VIEWS OF THE DRAWINGS

FIG. 1 is a view showing the cuff construction on a sweatshirt or the like;

DETAILED DESCRIPTION OF THE INVENTION

Figure 1:
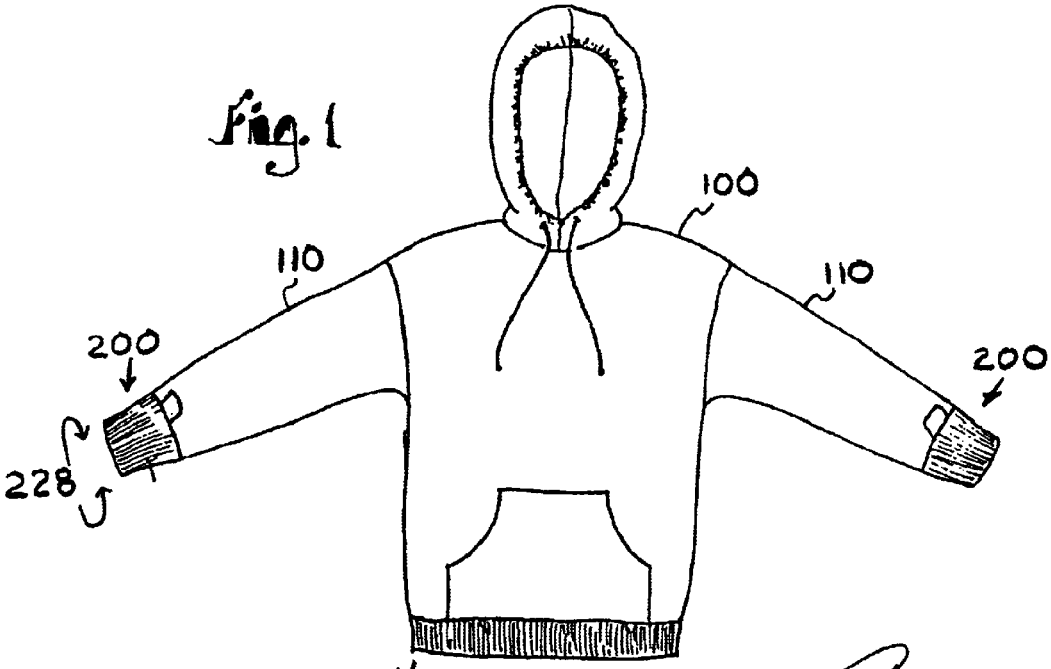

Turning more particularly to the drawings, FIG. 1 shows a sweatshirt 100 with sleeves 10, each sleeve 10 including a cuff construction 200 at the end thereof. The sleeve 10 presents an open end. At this open end is sewn the cuff construction 200 presenting a ribbed extension 228 of the sleeve. Cuff assembly 200 utilizes a flexible, ribbed extension 228 the ribs presenting a surface having greater friction than the garment material. A foldable panel 232 of the same material includes first and second longitudinal edges 234, 235 extending along the sleeve 110 and first and second lateral edges 236, 237 traversing the sleeve. Panel 232 covers only one half of the circumference of the sleeve. Edge 236 may be integral with or sewn along the end 229 of the sleeve extension 228 with edge 237 being a free edge longitudinally displaced therefrom. Upon sewing panel 232 edges 234, 235 to the sleeve extension, fold lines 234' and 235' are presented along the intersection of these edges 234, 235 with the sleeve extension.

Figure 2:
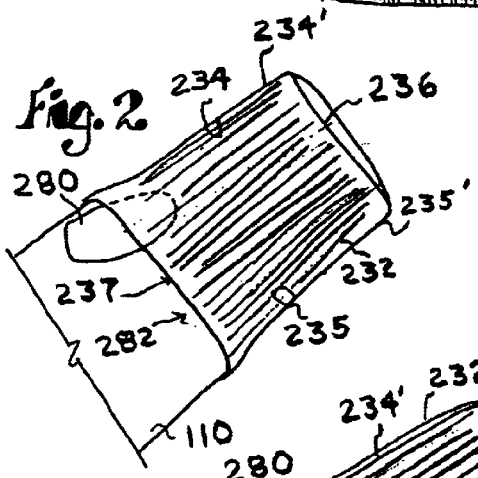
FIG. 2 is a view showing the cuff construction at one end of a sleeve with the cuff panel being at the open position and the thumb cover being extended along the FIG. 3 is a view as in FIG. 2 showing the initial movement of the cuff panel from its FIG. 2 open to its FIG. 4 closed, hand covering position.
Figure 3:
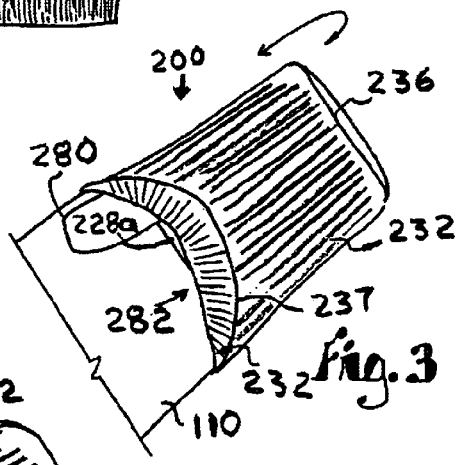

Panel 232 cooperates with portion 228*a* of the sleeve extension 238 to present a pocket 282 therebetween. The fold lines 234', 235' and integral edge 236 allow panel 232 to be folded about between a first FIG. 2 and a second FIG. 4 position with the intermediate position being shown in FIG. 3. In the FIG. 2 open position a wearer's hand may pass through the open end of the sleeve extension 228 whereas in the FIG. 4 closed position the open end is covered by the panel 232. Panel 232 is now on the opposed side of the sleeve having been folded from its FIG. 2 to its FIG. 4 position. Thus, panel 232 at its FIG. 2 position to present pocket 282 is now on the opposed side of the sleeve 228 forming a pocket with the opposed half of sleeve extension 228.

Figure 7:
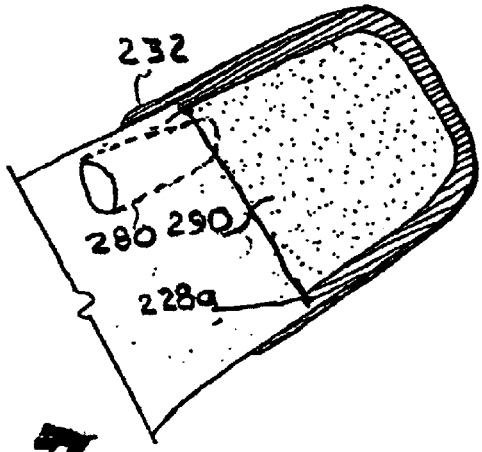
FIG. 7 is a view showing the thumb cover is in its depressed position.

Also included along the sleeve is a thumb cover 280 which at the open position can either be tucked into the pocket 282 formed between the folding panel 232 and extension 228 (FIG. 2) or can be depressed underneath the sleeve (FIG. 7). Thus, the thumb cover can be safely integrated into the garment 100 when not in use and not degrade the overall appearance of the garment.

Figure 4:
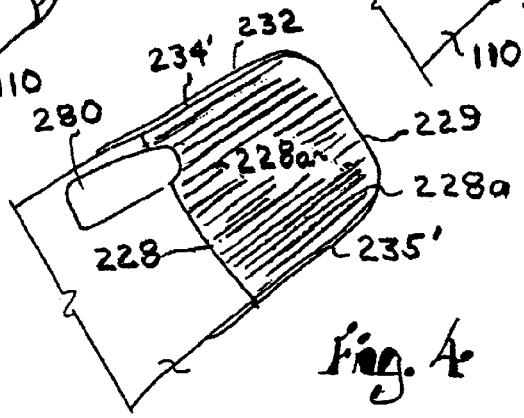
FIG. 4 is a view as in FIGS. 2 and 3 showing the cuff panel at a hand covering position.
Figure 5:
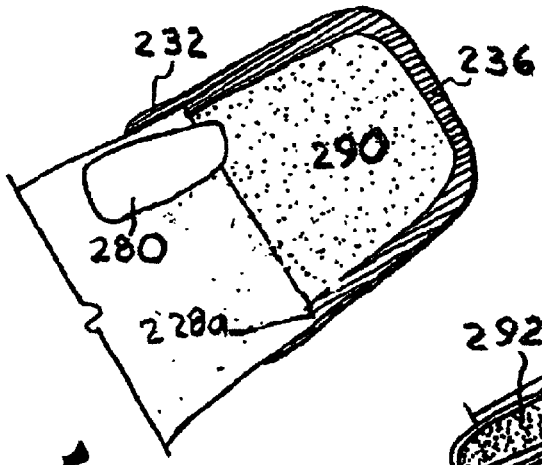
FIG. 5 is a view of the cuff construction at the FIG. 4 position showing a purchase surface enhancing article pick up.
Figure 6:
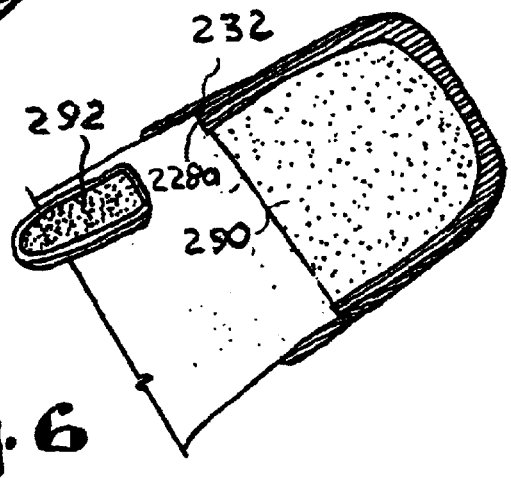
FIG. 6 is a view of the cuff construction in the FIG. 4 position showing a purchase surface on the thumb cover.

When the cuff assembly 200 is in a hand cover position (FIG. 4) a gripping surface 290 is presented along the finger cover portion 228*a* as shown in FIG. 5. Also, a purchase surface 292 on the thumb cover 280 is presented when removed from the pocket 282 or from beneath the sleeve as shown in FIG. 6. These surfaces may be a fake suede, a roughened or tacky surface or any other surface that enhances purchase with articles. By the use of such surfaces I have found that the user may more securely grasp objects when the cuff construction 200 is in its hand cover position (FIG. 4).

Accordingly, I have found that my construction presents not only a functional garment for selectably covering the hands but also allows the covered hands to easily grasp articles whether the cuff construction is in an open or closed position. Moreover, my construction also provides a separate thumb cover which can be selectably integrated with the article so as to not degrade the cosmetic appearance of the garment when the cuff assembly 200 is not at its closed position.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A cuff assembly at an open end of a sleeve of a garment, said assembly comprising:

a cuff attached about an open end of a sleeve, said cuff presenting a free edge surrounding an opening for projection of a user's hand therethrough;

a panel attached to said cuff, said panel having a first end integral with said free edge of said cuff and a second end displaced therefrom;

said panel further having first and second longitudinal edges attached along said cuff, wherein to present first and second fold lines therealong, said panel foldable along said fold lines and said first end between a first position wherein said opening of said cuff is uncovered by said panel and a second position wherein said opening of said cuff is covered by said panel, said panel at said second position adapted to cover a hand extending through the sleeve and said cuff opening;

a thumb cover projecting from the sleeve, said thumb cover having a first position along the sleeve inhibiting an extension of a user's thumb therein and a second position projecting from the sleeve adapted for extension of a user's thumb therein;

a purchase material at one end of said cuff, said purchase material exposed at said second panel position, said purchase material enhancing a user's grip of articles when said cuff is in said second position covering a user's hand.

2. The cuff assembly as claimed in claim 1 further comprising a purchase material on said thumb cover for enhancing a user's pick up of articles when the thumb is in said thumb cover at said second thumb cover position.

3. The cuff assembly as claimed in claim 1 wherein said thumb cover at said first position is insertable between said panel and said cuff at said panel first position, whereby to maintain said thumb cover along the sleeve.

4. The cuff assembly as claimed in claim 1 wherein said thumb cover at said first position is positioned underneath the sleeve, whereby to maintain said thumb cover along the sleeve.

5. The cuff assembly as claimed in claim 1 wherein at least said panel of said cuff assembly is made of a material having a greater gripping surface relative to a material of the sleeve.

6. The cuff assembly as claimed in claim 1 wherein at least said panel of said cuff assembly is made of a ribbed material providing an enhanced gripping surface relative to a material of the sleeve.

7. The cuff assembly as claimed in claim 1 wherein said panel covers approximately one half a circumference of said cuff.

8. A cuff assembly at an open end of a sleeve of a garment, said assembly comprising:

a cuff attached about an open end of a sleeve, said cuff presenting a free edge surrounding an opening for projection of a user's hand therethrough;

a purchase surface on said cuff;

a panel attached to said cuff, said panel having a first end integral with said free edge of said cuff;

said panel foldable along said free edge between a first position wherein said panel is displaced from said opening while covering said purchase surface and a second position covering said opening and exposing said purchase surface, said panel at said second position adapted to cover a hand extending through the sleeve and said cuff opening with said exposed purchase surface enhancing the covered hand to grip objects.

9. The cuff assembly as claimed in claim 8 further comprising a thumb cover projecting from the sleeve, said thumb cover adapted for extension of a user's thumb therein.

10. The cuff assembly as claimed in claim 9 further comprising a purchase surface on said thumb cover, said thumb cover purchase surface enhancing the thumb therein to grip objects.

11. The cuff assembly as claimed in claim 8 wherein said panel covers a portion of a circumference of said cuff.

12. The cuff assembly as claimed in claim 8 further comprising a thumb cover projecting from the sleeve, said thumb cover having a first position along the sleeve and a second position projecting from the sleeve upon said panel being at said second position, said thumb cover at said second position adapted for extension of a user's thumb therein.

13. The cuff assembly as claimed in claim 12 further comprising a purchase surface on said thumb cover exposed for use at said second thumb cover position.

14. A cuff assembly at an open end of a sleeve of a garment, said assembly comprising:

a cuff attached about an open end of a sleeve, said cuff presenting a free edge surrounding an opening for projection of a user's hand therethrough;

a panel attached to said cuff, said panel having a first end integral with said free edge of said cuff and a second end displaced therefrom;

said panel further having first and second longitudinal edges attached along said cuff, wherein to present first and second fold lines therealong, said panel foldable along said fold lines and said first end between a first position wherein said opening of said cuff is uncovered by said panel and a second position wherein said opening of said cuff is covered by said panel, said panel at said second position adapted to cover a hand extending through the sleeve and said cuff opening;

a purchase material at one end of said cuff, said purchase material exposed at said second panel position, said purchase material enhancing a user's grip of articles when said panel is in said second position covering a user's hand.

15. The cuff assembly as claimed in claim 14 further comprising a thumb cover projecting from the sleeve and adapted for insertion of a user' thumb therein.

16. The cuff assembly as claimed in claim 15 wherein said thumb cover has a first position along the sleeve and a second position projecting from the sleeve upon said panel being at said second position, said thumb cover at said second position for said insertion of a user's thumb therein.

17. The cuff assembly as claimed in claim 15 further comprising a purchase surface on said thumb cover, said thumb cover purchase surface enhancing the covered thumb to grip objects.

18. The cuff assembly as claimed in claim 16 further comprising a purchase surface on said thumb cover, said thumb cover exposed at said second thumb cover position enhancing the cover thumb to grip objects.

* * * * *